US011484894B2

(12) United States Patent
Arenson et al.

(10) Patent No.: US 11,484,894 B2
(45) Date of Patent: Nov. 1, 2022

(54) LOW DRIFT, HIGH EFFICIENCY SPRAYING SYSTEM

(71) Applicant: Spraying Systems Co., Wheaton, IL (US)

(72) Inventors: Marc A. Arenson, Bartlett, IL (US); Daniel J. Cederberg, South Elgin, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 16/928,135

(22) Filed: Jul. 14, 2020

(65) Prior Publication Data

US 2021/0016303 A1 Jan. 21, 2021

Related U.S. Application Data

(60) Provisional application No. 62/874,183, filed on Jul. 15, 2019.

(51) Int. Cl.
*B05B 1/26* (2006.01)
*B05B 1/04* (2006.01)

(52) U.S. Cl.
CPC ..... *B05B 1/267* (2013.01); *B05B 1/046* (2013.01)

(58) Field of Classification Search
CPC ..... B05B 1/267; B05B 1/046; B05B 1/044; B05B 1/04
See application file for complete search history.

(56) References Cited

U.S. PATENT DOCUMENTS 4,718,607 A * 1/1988 Levine ..... B05B 7/0416 239/597
4,790,485 A * 12/1988 Yamamoto ..... B05B 1/26 239/707

(Continued)

FOREIGN PATENT DOCUMENTS

GB 2526799 A 12/2015
WO WO 2005/084815 A2 9/2005

(Continued)

OTHER PUBLICATIONS

European Patent Office, International Search Report and Written Opinion in corresponding International Patent Application No. PCT/US2020/041880 dated Nov. 16, 2020 (14 pages).

*Primary Examiner* — Joseph A Greenlund
(74) *Attorney, Agent, or Firm* — Leydig, Voit & Mayer Ltd.

(57) ABSTRACT

A spray tip including a spray tip body and flow control element is provided. The flow control element includes a pre-orifice through which fluid can enter a primary fluid passage of the spray tip body. First and second discharge orifices are provided in a dome-shaped end wall of the spray tip body with each of the first and second discharge orifices being arranged on a respective one of opposing first and second sides of an apex of the dome-shaped end wall. Each of the first and second discharge orifices having an elongated slot-like configuration that maintains a substantially constant width as the respective discharge orifice extends from a first end to a second end and each and each extending a substantially equal distance to either side of the apex of the dome-shaped end wall.

18 Claims, 10 Drawing Sheets

(56) References Cited

U.S. PATENT DOCUMENTS 4,946,107 A * 8/1990 Hunt ..... F02M 51/0667 239/585.4
5,316,218 A * 5/1994 Bowen ..... B05B 13/0636 239/246
5,372,312 A 12/1994 Vidusek
5,597,122 A * 1/1997 Eisenmann ..... B05B 1/042 239/597
5,673,859 A * 10/1997 Haruch ..... B05B 7/0483 239/434
5,921,472 A * 7/1999 Haruch ..... B05B 1/26 239/432
6,098,896 A * 8/2000 Haruch ..... B05B 1/04 239/432
7,086,613 B2 * 8/2006 Hennessy ..... B05B 1/3053 239/417.5
7,380,732 B2 * 6/2008 Bolman ..... B05B 1/262 239/597
7,552,881 B2 * 6/2009 Lipthal ..... B05B 1/048 239/524
8,079,533 B2 * 12/2011 Bowen ..... B05B 3/06 239/237
D723,136 S * 2/2015 Roberts ..... D23/213
D811,521 S * 2/2018 Bamford ..... D23/213
9,970,356 B2 * 5/2018 Okazaki ..... F02C 7/22
10,201,794 B2 * 2/2019 Lacroix ..... B01J 8/22
10,415,219 B2 * 9/2019 Bamford ..... E03C 1/02
10,702,876 B2 * 7/2020 Slutskii ..... B05B 7/0416
D912,201 S * 3/2021 Arenson ..... D23/213
D926,922 S * 8/2021 Arenson ..... D23/213
11,103,889 B2 * 8/2021 Foshag ..... B05B 1/042
2003/0234301 A1 * 12/2003 Swan ..... B05B 7/0425 239/597
2004/0144869 A1 * 7/2004 Hennessy ..... B05B 1/3053 239/584
2004/0155125 A1 * 8/2004 Kramer ..... B05B 1/14 239/601
2008/0217437 A1 * 9/2008 Vanden Berghe .... B05B 1/3053 239/585.5
2008/0283635 A1 * 11/2008 Fecht ..... B05B 1/042 419/36
2012/0100272 A1 * 4/2012 DeVoll ..... A23L 3/3589 118/24
2015/0321206 A1 * 11/2015 Swan ..... A01C 23/047 239/8
2017/0183849 A1 * 6/2017 Bamford ..... E03C 1/02
2017/0336123 A1 * 11/2017 Dodson ..... B05B 1/044
2018/0029566 A1 * 2/2018 Gopalan ..... B60S 1/46
2018/0104705 A1 * 4/2018 Slutskii ..... E04B 1/7604
2019/0151865 A1 * 5/2019 Zhao ..... B05B 1/16
2020/0101431 A1 * 4/2020 Lesage ..... B05B 7/0075
2020/0353485 A1 * 11/2020 Arenson ..... B05B 7/2475
2021/0016303 A1 * 1/2021 Arenson ..... B05B 1/267

FOREIGN PATENT DOCUMENTS

WO WO 2014/111542 A1 7/2014
WO WO 2018/129376 A2 7/2018
WO WO 2018/172474 A1 9/2018

* cited by examiner

LOW DRIFT, HIGH EFFICIENCY SPRAYING SYSTEM

CROSS-REFERENCE TO RELATED APPLICATIONS

This patent application claims the benefit of U.S. Provisional Patent Application No. 62/874,183, filed Jul. 15, 2019. The foregoing application is incorporated by reference.

BACKGROUND OF THE INVENTION

Spray devices have long been used in the agricultural industry for spraying liquids onto the agricultural products. These liquids are frequently discharged from moving vehicles such as trucks or tractors. One issue with spraying of some volatile liquids used in agricultural applications such as pesticides, herbicides and fungicides is the production of fine particles (e.g., particles less than 150 microns) that can drift to, and thereby pollute, surrounding areas. Accordingly, spray devices that produce fewer fine particles are desirable in such applications. One example of such a spray device is an air induction spray nozzle. Air induction spray nozzles utilize air passages that draw air into the nozzle body with the liquid which slows the flow of liquid allowing larger liquid drops to form.

A related issue with spraying liquids from a moving vehicle is that speed of vehicle can change. For example, if the vehicle moves faster, the liquid must be pumped at a higher pressure in order to maintain the same application rate. But, increasing the pressure of the liquid being sprayed leads to smaller droplets and thus more undesirable spray drift.

Pulse width modulation is one way in which to avoid the need to adjust the pressure of the liquid being sprayed when the speed of the vehicle changes. Spray nozzles equipped with pulse width modulation alternate very quickly between open and closed flow conditions. Changing the amount of time the pulse width modulation equipped nozzle is open or closed allows the rate of flow to be adjusted without changing the pressure. However, with an air induction nozzle, the rapid change between open and closed flow conditions can cause the air entrapment into the nozzle to stop. When this happens, since it is the flow of liquid that draws the air into the nozzle, the air will not start back up as quickly as the liquid when the nozzle reopens leading to a period of bad flow through the nozzle that can result in poor spray distribution and decreased droplet size leading to unwanted drift.

OBJECTS OF THE INVENTION

In view of the foregoing, a general object of the present invention is to provide a spraying system that produces consistently good spray coverage with a minimal amount of spray drift.

A related object of the present invention is to provide a spraying system that can be effectively used with pulse width modulation without degradation of the spray performance.

A further object of the present invention is to provide a spraying system that produces a consistent drop size and uniform spray distribution when operating with pulse width modulation.

A further object of the present invention is to provide a spraying system that is relatively simple in design and inexpensive to manufacture.

Another object of the present invention is to provide a spraying system that is can be easily adapted for a wide range of different flow capacities.

Other objects and advantages of the invention will become apparent upon reading the following detailed description and upon reference to the drawings. The identified objects are not intended to limit the present invention.

DETAILED DESCRIPTION OF THE INVENTION

Figure 1:
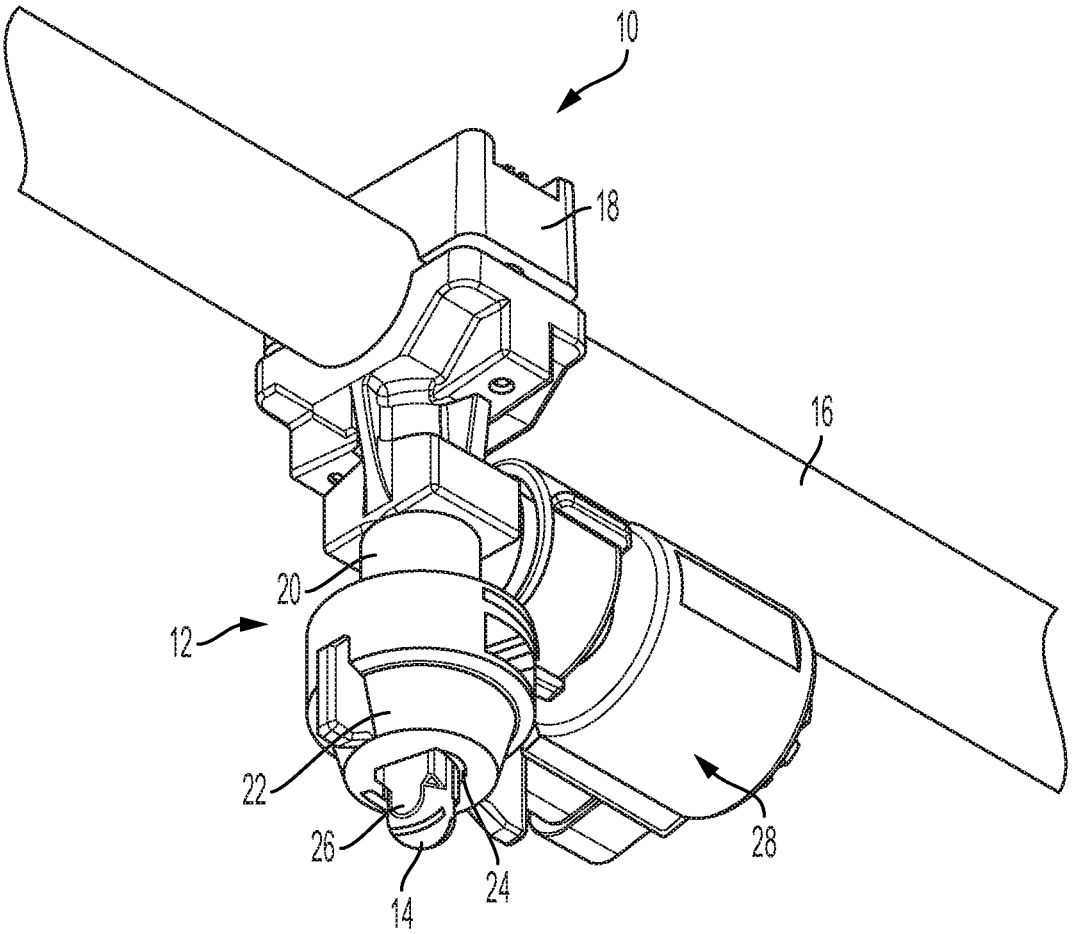
FIG. 1 is a perspective view of a spraying system including a spray nozzle assembly according to the teachings of the present invention.

Referring to FIG. 1 of the drawings, there is shown an exemplary embodiment of a spraying system 10 including a spray nozzle assembly 12 with a spray tip 14 (better shown in FIG. 2) configured in accordance with the present invention. The illustrated spray nozzle assembly 12 with spray tip 14 is configured to produce relatively large droplet sizes making it particularly well suited for discharging chemicals such as pesticides, herbicides and fungicides in agricultural and lawn and garden care environments in which a minimal amount of spray drift is desirable. However, the present invention is not limited to the spraying of such liquids or use in such environments. Rather, the spraying system 10, spray nozzle assembly 12 and spray tip 14 of the present invention is intended for spraying any suitable liquid in which a relatively large droplet size may be advantageous.

In the embodiment illustrated in FIG. 1, the spraying system 10 generally includes the spray nozzle assembly 12 mounted on a header or boom 16. The boom 16 is configured to deliver fluid to the spray nozzle assembly 12, and to this end, the boom 16 may be connected to a pressurized fluid supply. In the case of the illustrated embodiment, the spray nozzle assembly 12 is connected to the boom 16 via a clamp assembly 18. Other methods of attaching the spray nozzle assembly 12 to the boom 16 could also be used. Moreover, while only one is shown in FIG. 1, the spray nozzle assembly 12 may be one of a plurality of spaced apart spray nozzle assemblies on the boom 16. The spray nozzle assembly 12 of the present invention is also not limited to use on a header or boom 16 such as shown in FIG. 1. To the contrary, the spray nozzle 12 and spray tip 14 of the present invention may be used with any suitable apparatus for delivering fluid to the spray nozzle assembly 12.

For discharging the fluid, the spray tip 14 is arranged at the distal end of the spray nozzle assembly 12. In the illustrated embodiment, the spray tip 14 is connected to a distal end of a nozzle body 20 by a retaining cap 22 with a central opening 24. In this case, the central opening 24 in the retaining cap 22 has a rectangular configuration and the external surface of the spray tip 14 has a complementary generally rectangular cross-sectional configuration near the inlet end 26 thereof such that the spray tip 14 protrudes through and is rotationally secured in the central opening 24 when the spray tip 14 is connected to the nozzle body 20 by the retaining cap 22. Of course, the retaining cap 22 and external surface of the spray tip 14 may have configurations other than that shown in the drawings.

For producing an oscillating on/off flow condition, the illustrated spray nozzle assembly 12 is also equipped with a pulse width modulation assembly 28. The pulse width modulation assembly 28 is configured to allow the spray nozzle assembly 12 to achieve a pulsing flow that rapidly alternates between on and off flow conditions. To this end, the pulse width modulation assembly 28 may include an electrically actuated on/off solenoid valve that can oscillate rapidly between an open position in which fluid is allowed to pass to the spray tip 14 and a closed position in which the flow of fluid to the spray tip 14 is blocked. The pulse width modulation assembly 28 may be of a commercially known type such as offered by Spraying Systems Co., assignee of the present application, under the trademark PulsaJet. Various components and their mode of operation of the illustrated spray nozzle assembly and pulse width modulation assembly may be similar to those described in U.S. Pat. No. 7,086,613, the disclosure of which is incorporated herein by reference.

As discussed above, the use of the pulse width modulation assembly 28 can allow the flow rate produced by the spray nozzle assembly 12 to be adjusted without changing the pressure of the fluid supply simply by adjusting the on/off duty cycle of the spray nozzle assembly 12 via the pulse width modulation assembly 28. In a situation in which the spray nozzle assembly 12 is mounted on a moving vehicle, this ability to change the flow rate can enable an operator to keep the application rate constant without adjusting the pressure of the fluid even when the speed of the vehicle changes. This is advantageous because changes in pressure can change the discharge pattern and droplet size produced by the spray nozzle assembly 12 leading to inconsistent results and possibly unwanted spray drift. While the inclusion of the pulse width modulation assembly 28 can offer benefits in certain applications, the spray nozzle assembly 12 of the present invention need not include pulse width modulation. However, as discussed further below, unlike conventional air induction nozzles, the spray nozzle assembly 12 and spray tip 14 of the present invention can include pulse width modulation without adversely impacting the performance of the nozzle.

Figure 2:
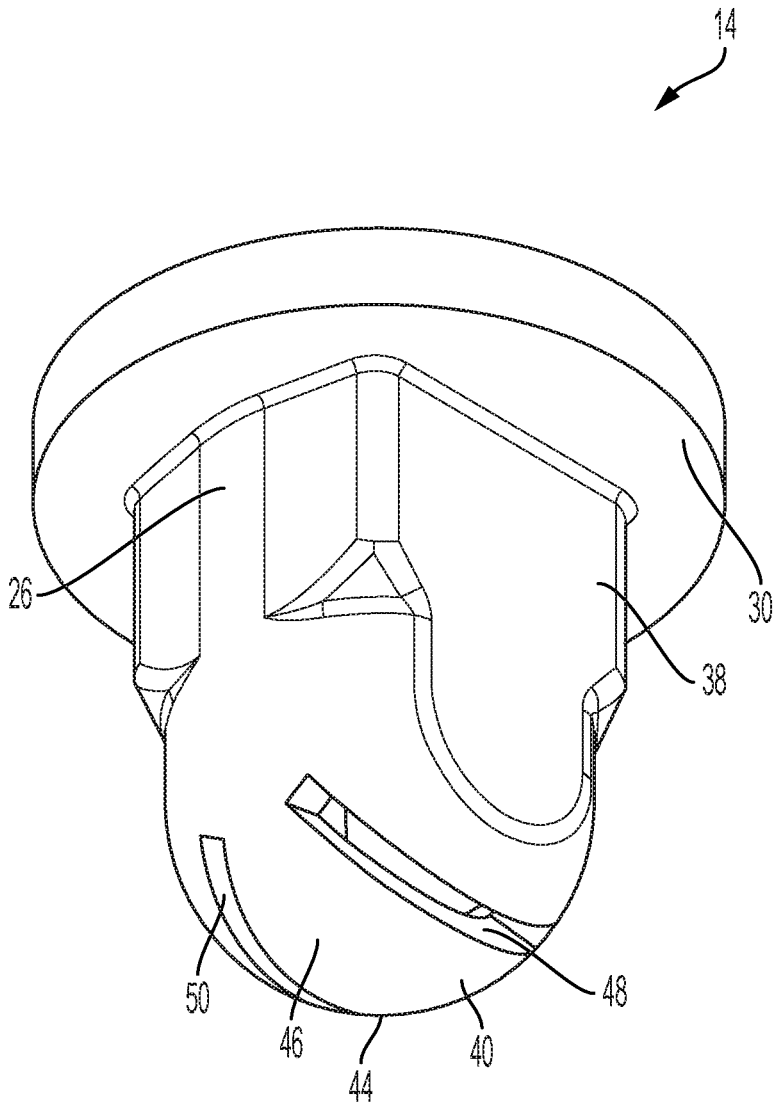
FIG. 2 is a perspective view of the spray tip of the spray nozzle assembly of FIG. 1.

Referring to FIG. 2 of the drawings, there is shown an enlarged perspective view of an exemplary embodiment of the spray tip 14. For helping to secure the spray tip 14 to the nozzle body 20, a flange 30 is provided at the upstream (with reference to the direction of fluid flow), inlet end 26 of the spray tip 14 as shown in FIG. 2. This flange 30 is configured to be captured at the distal end of the nozzle body 20 by the retaining cap 22 to help secure the spray tip 14 to the nozzle body 20 with a substantial portion of the spray tip 14 protruding through the central opening 24 of the retaining cap 22 as noted above.

Figure 3:
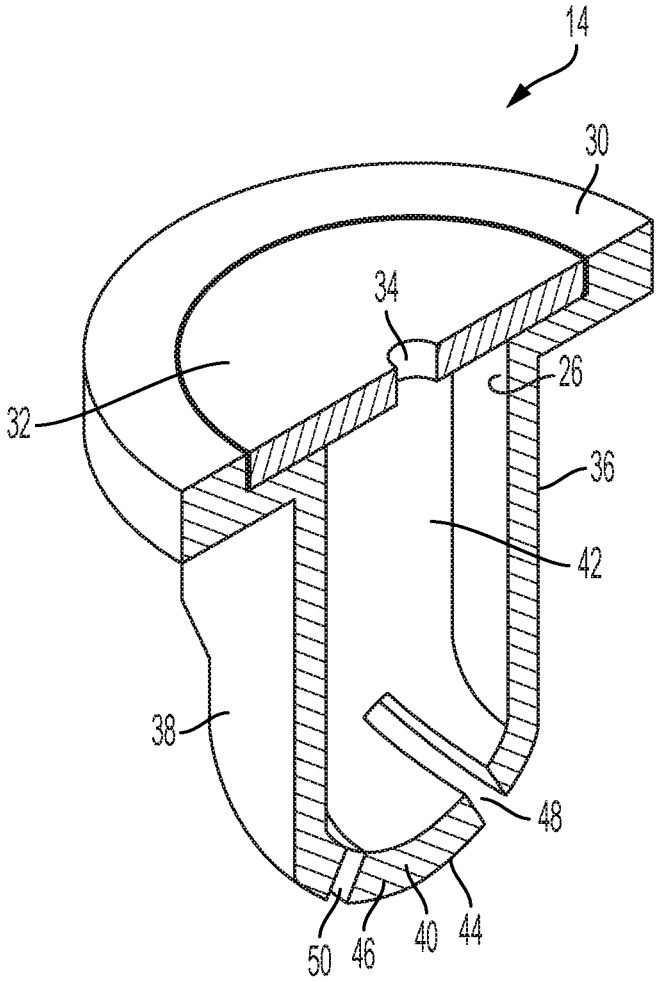
FIG. 3 is a perspective, longitudinal section view of the spray tip of FIG. 2.
Figure 4:
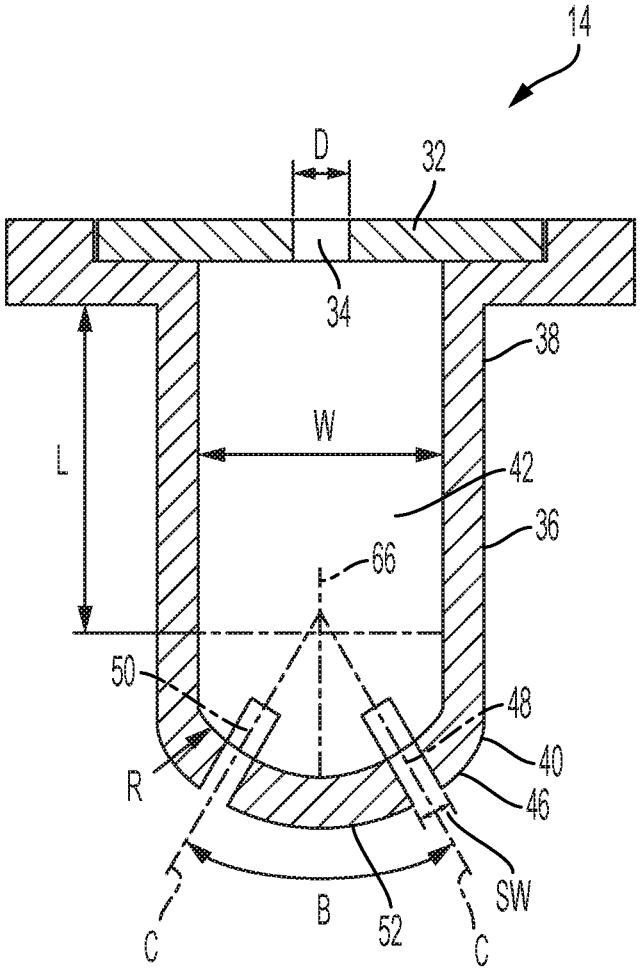
FIG. 4 is a side sectional view of the spray tip of FIG. 2.
Figure 6:
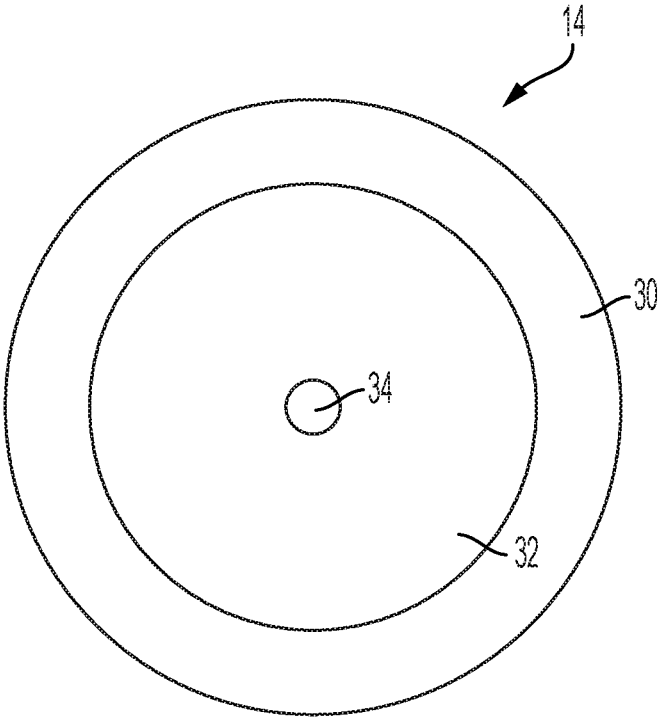
FIG. 6 is an end view of the spray nozzle of FIG. 2 showing the inlet end of the tip.

For metering the rate of flow of fluid into the spray tip 14, a flow control element 32 is provided at the inlet end 26 of the spray tip 14 as shown in FIGS. 3, 4 and 6. In the illustrated embodiment, the flow control element 32 consists of a disc-shaped member that is received in a corresponding opening in the inlet end 26 of the spray tip 14. The illustrated flow control element 32 is configured as an insert that is a separate piece from the remainder of the spray tip 14. However, in an alternative embodiment, the flow control element 32 may be integrally formed with the rest of the spray tip 14. The flow control element 32 includes a centrally disposed pre-orifice 34 through which fluid enters the spray tip 14. In operation, this pre-orifice 34 produces a first pressure drop of the fluid supplied from the boom 16 as it enters the spray tip 14. The diameter D (see FIG. 4) of the central pre-orifice 34 may be varied in order to provide a desired flow capacity for the spray tip 14.

As best shown in FIGS. 2-4, 7 and 8, the spray tip 14 includes a body 36 having an upstream elongated first body portion 38 and a downstream hemispherical or convex second body portion 40. The elongated first portion 38 and the hemispherical second portion 40 together define an internal fluid passage 42 extending from the inlet end 26 of the spray tip 14 to a discharge end 44 of the spray tip 14 as shown in FIGS. 3 and 4. The pre-orifice 34 in the flow control element 32 communicates with the internal fluid passage 42 at a upstream end thereof. The elongated first portion 38 of the internal fluid passage 42 is configured to allow fluid to build up in the spray tip body 36. As it builds up, the fluid in the elongated first portion 38 of the internal fluid passage 42 loses velocity. The length L (see FIG. 4) of the elongated first portion 38 may be varied based on the desired flow capacity for the spray tip 14 with longer lengths L of the elongated first portion 38 (and a resultant increased volume of the internal fluid passage 42) corresponding to greater flow rates. The length L of the elongated first portion 38 of the spray tip body 36 may be selected such that the fluid exits the spray tip 14 at approximately the same velocity across all spray tip flow capacities. The diameter or width W (see FIG. 4) of the elongated first portion 38 may remain constant across the different spray tip flow capacities. According to one embodiment, the elongated first portion 38 may have a length L of approximately 0.30 inches to approximately 0.45 inches.

The hemispherical second portion 40 of the spray tip body 36, which is arranged downstream of the elongated first portion 38 and terminates in a dome-shaped end wall 46, provides a second pressure drop for the fluid being sprayed. The hemispherical portion 36 is also configured to provide atomization of the fluid in the spray nozzle 12. In one embodiment, the dome-shaped end wall 46 has a consistent radius R (see FIG. 4) no matter the desired flow capacity of the spray tip 14.

Figure 7:
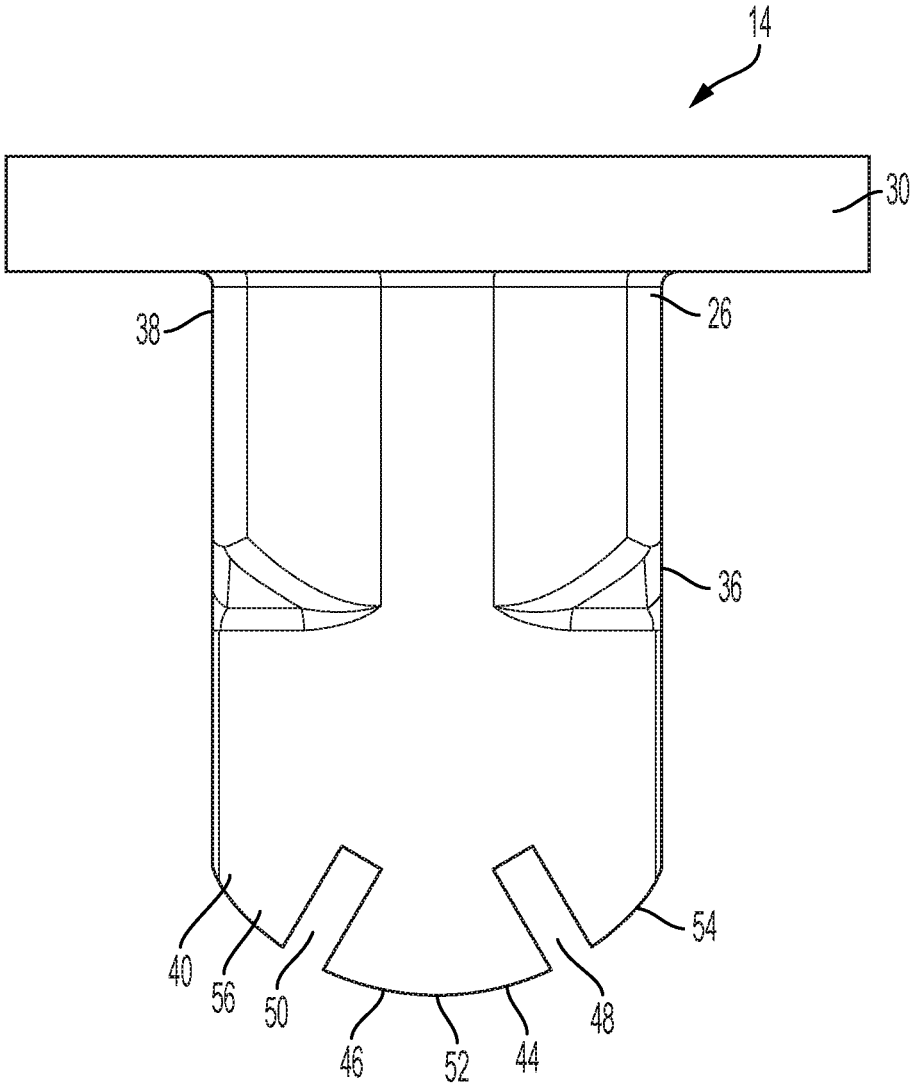
FIG. 7 is a side elevation view of the spray tip of FIG. 2.
Figure 8:
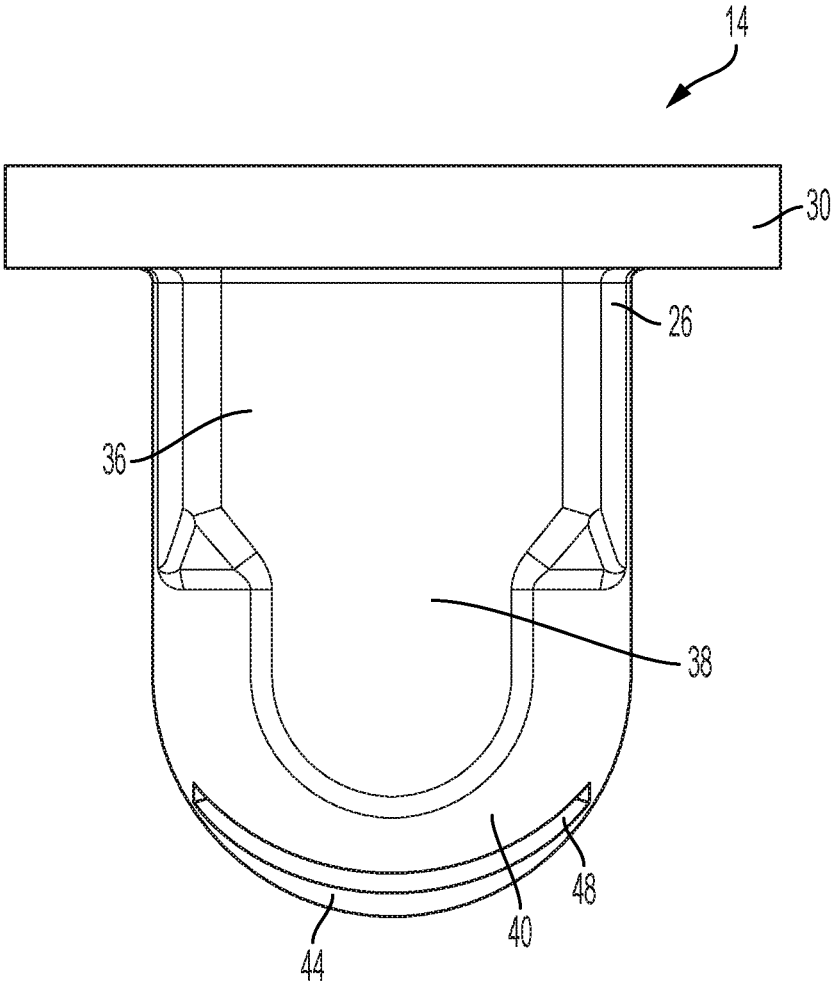
FIG. 8 is another side elevation view of the spray tip of FIG. 2 showing the side rotated 90° from the side shown in FIG. 7.

For producing a uniform, tapered spray distribution pattern, two discharge orifices 48, 50 are provided in the dome-shaped end wall 46 of the hemispherical second portion 40 of the spray tip body 36. The two discharge orifices 48, 50 are offset from each other on opposite sides of the apex 52 of the dome shaped end wall 46 as shown in the end view of FIG. 5. In particular one discharge orifice 48 is arranged on a first side 54 of the end wall 46 while the other discharge orifice 50 is arranged on a second side 56 of the end wall 46 as can be seen in FIG. 7. The two discharge orifices 48, 50 are identically configured and mirror images of each other.

Figure 5:
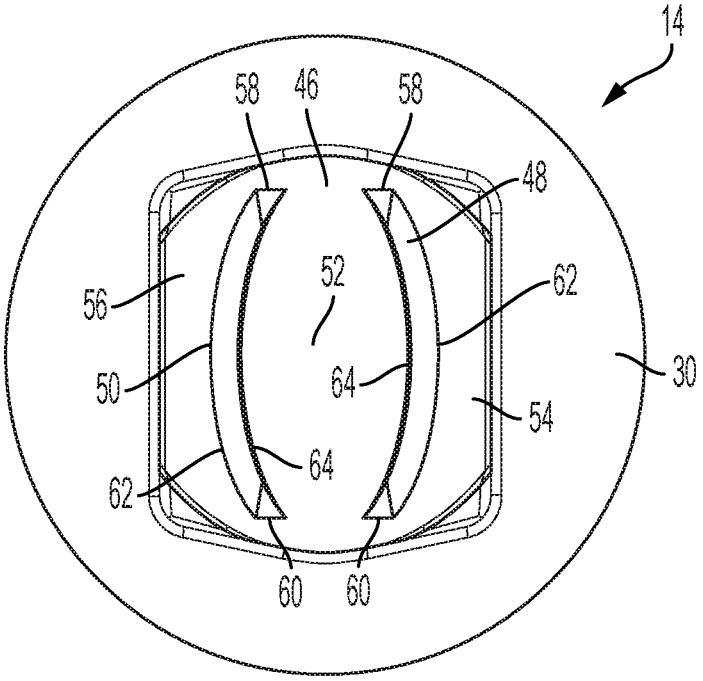
FIG. 5 is an end view of the spray tip of FIG. 2 showing the discharge end of the tip.

Each discharge orifice 48, 50 has an elongated slot-like configuration that maintains a constant width SW (see FIG. 4) as it extends from a first end 58 to a second end 60 with the external lateral edges 62, 64 of each orifice 48, 50 (see FIG. 5) extending in an arc over the dome-shaped end wall 46. The two discharge orifices 48, 50 each extend the same length with each slot-like orifice 48, 50 extending an equal distance to either side of the apex 52 as shown in FIG. 5. Because the discharge orifices 48, 50 are formed in the dome-shaped end wall 46, each slot is longer at the external surface of the end wall 46 than at the interior surface of the end wall 46. Additionally, as shown in FIG. 4, the centerline C of each discharge orifice 48, 50 is at substantially the same angle with respect to the longitudinal axis 66 of the nozzle body 36. In the illustrated embodiment, the outlet angle B of the two discharge orifices 48, 50 as defined by the angle formed by the centerlines C of the discharge orifices 48, 50 is approximately 60°. The outlet angle B may remain substantially constant across spray tips 14 having different flow capacities in order for such spray tips to produce substantially similar spray patterns. However, the outlet angle B may be varied if a different spray discharge pattern is desired.

The width SW of the discharge orifices 48, 50 can vary depending on the desired flow capacity of the spray tip 14 with relatively wider slots used with spray tips 14 having higher flow capacities. According to one embodiment, the width SW of the discharge slots 48, 50 can be from approximately 0.22 inches to approximately 0.44 inches. Moreover, the width SW of the discharge orifices 48, 50 and the diameter D of pre-orifice 34 may be selected so as to maintain the flow ratio between the pre-orifice 34 and the discharge orifices 48, 50 at approximately 4:1.

In operation, the spray tip 14 produces a dual spray pattern with a relatively large droplet size without the use of air induction. The droplet size may be categorized as ultra-coarse as defined by ISO25358 at operating pressure. The pre-orifice diameter D, length L of the first portion 38 of the spray tip body 36, and the width SW of the discharge orifices 48, 50 may be varied to configure the spray tip 14 to achieve flow capacities of between approximately 0.15 gpm and approximately 1.2 gpm while reducing fines and maintaining a uniform tapered spray across all rated operating pressures. Moreover, because it employs a more direct flow path and does not use secondary air induction inlets, the spray tip 14 is configured so that it can be operated using pulse width modulation without any adverse effects in terms of droplet size or spray distribution. It should be understood that all of the dimensions and flow capacities referenced herein are with reference to exemplary embodiments of the spray nozzle assembly and spray tip.

Figure 9:
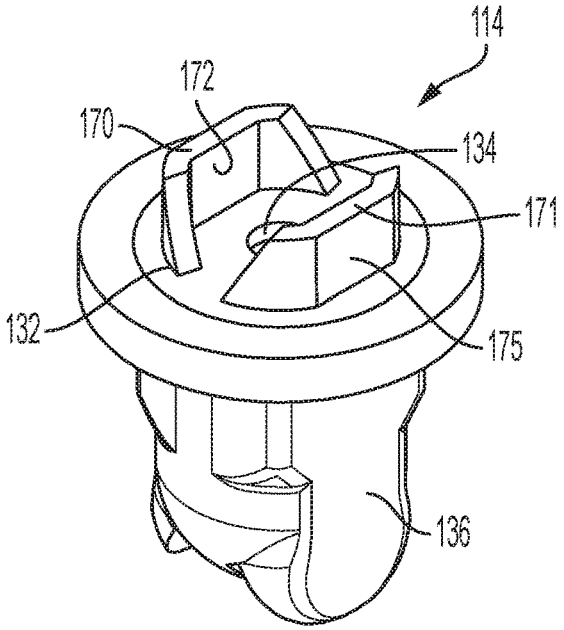
FIG. 9 is a perspective view of an alternative embodiment of a spray tip according to the teachings of the present invention looking towards the inlet end of the spray tip.
Figure 10:
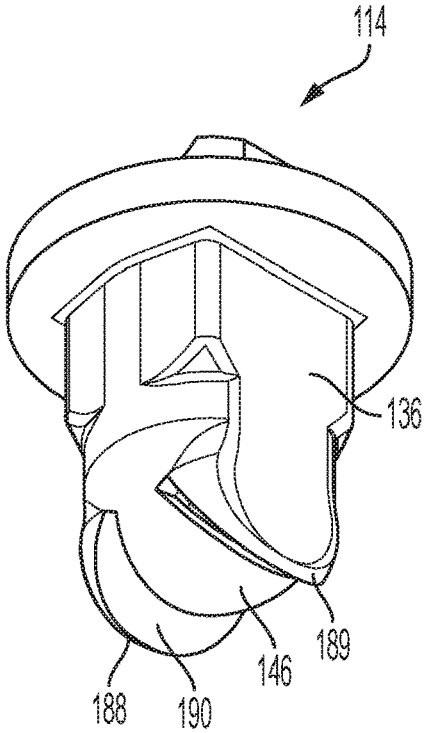
FIG. 10 is perspective view of the spray tip of FIG. 9 looking towards the discharge end of the spray tip.
Figure 11:
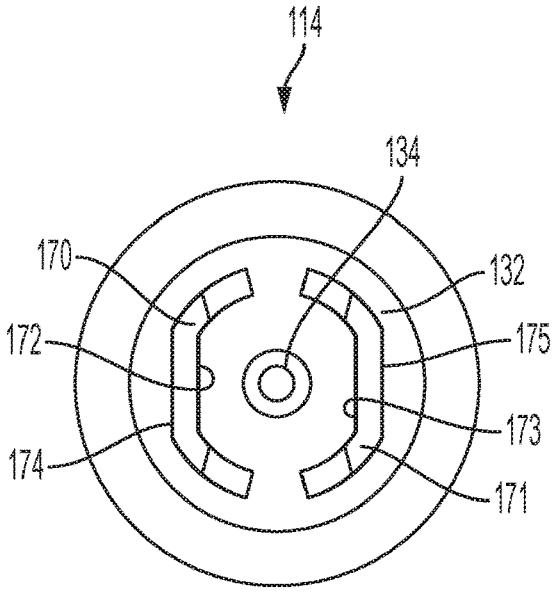
FIG. 11 is an end view of the spray tip of FIG. 9 showing the inlet end of the spray tip.

An alternative embodiment of a spray tip 114 which can be used with the spray nozzle assembly 12 of FIG. 1 is shown in FIGS. 9-17. In the description of the FIGS. 9-17 embodiment, similar components to those present in the FIGS. 2-8 embodiment are referenced with similar reference numbers in the 100s. Like the embodiment of FIGS. 2-8, the inlet end of the spray tip 114 has a flow control element 132 that includes a pre-orifice 134 through which fluid enters the spray tip 114 (see, e.g., FIGS. 11 and 14). As shown in FIGS. 9 and 11, the upstream surface of the flow control element 132 includes in this case two flow control guides 170, 171 which are arranged near, equally spaced from, and on opposing sides of the pre-orifice 134. Each flow control guide 170, 171 extends in the upstream direction from the surface of the flow control element 132. As shown in FIG. 11, the flow control guides 170, 171 each have a generally C-shaped configuration that is substantially centered on the pre-orifice 134 with the two flow control guides 170, 171 partially encircling the pre-orifice 134. The flow control guides 170, 171 each have an inner surface 172, 173 (see FIGS. 9 and 17) that is substantially smooth in the direction of flow that is configured to facilitate laminar flow of fluid to the pre-orifice 134. The flow control guides 170, 171 further include opposing flat gripping surfaces 174, 175 (see FIGS. 9 and 11) on their outer surfaces that are configured to be grasped by a user or a tool to help in removing the flow control element 132 from the body 136 of the spray tip 114. The flow control guides 170, 171 may also be configured to help a user to properly orient the flow control element 132 in the body 136 of the spray tip 114. While in the illustrated embodiment two flow control guides 170, 171 are provided that partially encircle the pre-orifice 134, other flow control guide configurations could also be used including three or more flow control guides or a single or multiple flow control guides that completely encircle the pre-orifice.

Figure 14:
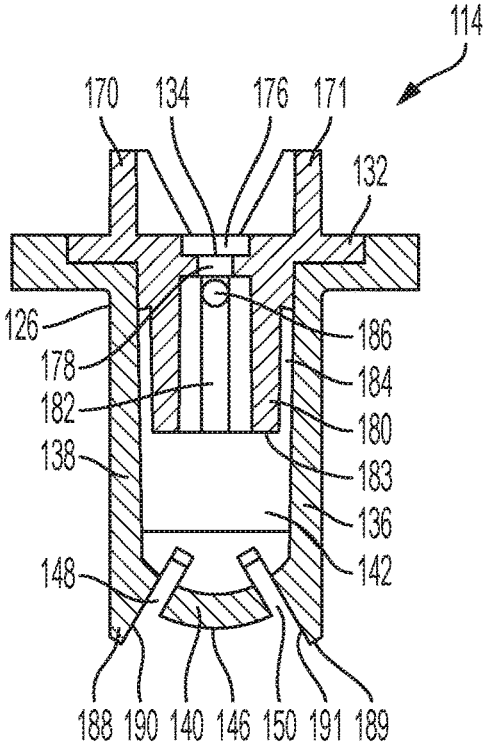
FIG. 14 is a longitudinal section view of the spray tip of FIG. 9 taken in the plane of the line 14-14 of FIG. 13.
Figure 15:
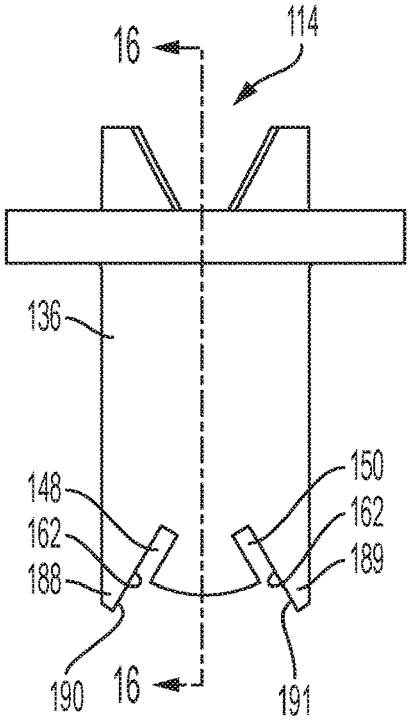
FIG. 15 is a side elevation view of the spray tip of FIG. 9.
Figure 16:
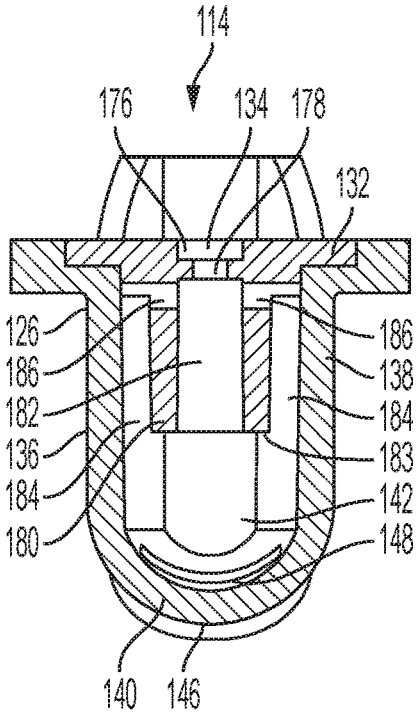
FIG. 16 is a longitudinal section view of the spray tip of FIG. 9 taken in the plane of the line 16-16 of FIG. 15.

In the embodiment of FIGS. 9-17, the pre-orifice 134 is configured with a relatively larger diameter upstream section 176 and a relatively smaller diameter downstream section 178 as shown in FIGS. 14 and 16. This configuration assists in making flow into the pre-orifice 134 more laminar. The configuration can also help with respect to manufacturing the product and, in particular, with providing greater control over the diameter of the pre-orifice 134 during the manufacturing process. However, it will be appreciated that a pre-orifice 134 with a constant diameter may also be used. As in the embodiment of the FIGS. 2-8, the pre-orifice 134 produces a first pressure drop as fluid enters the spray tip 114.

Figure 17:
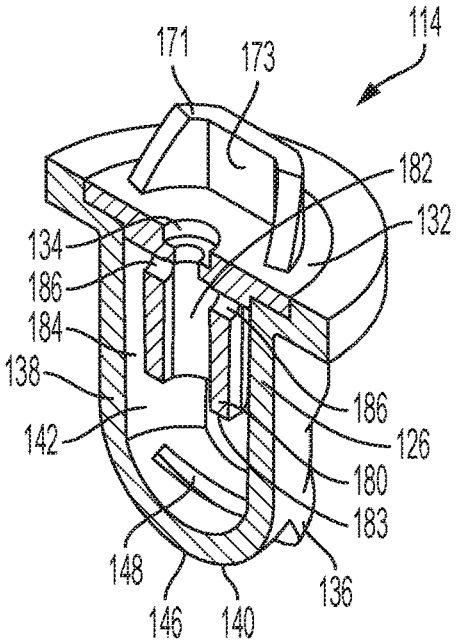
FIG. 17 is a perspective longitudinal section view of the spray tip of FIG. 9.

To assist in reducing the velocity of the fluid discharged from the spray tip 114 and thereby increase the size of the droplets, a reduced diameter secondary chamber 180 is provided in the interior of body 136 of the spray tip 114 as shown in FIGS. 14, 16 and 17. The secondary chamber 180, in this case, is attached to the downstream side of the flow control element 132 and has a substantially cylindrical configuration that defines a secondary fluid passage 182 within the primary fluid passage 142. More specifically, the secondary chamber 180 is arranged such that fluid that enters the spray tip 114 via the pre-orifice 134 is communicated directly into the secondary fluid passage 182 of the secondary chamber 180. As shown in the figures, the secondary chamber 180 extends less than the entire length of the elongated first portion 138 of the body 136 of the spray tip 114 and is open at its downstream end 183 such that fluid exiting the secondary fluid passage 182 of the secondary chamber 180 is directed into the primary internal fluid passage 142 of the spray tip body 136.

To allow for some recirculation of fluid back into the secondary chamber 180, the secondary chamber 180 has an outer diameter that is less than the inner diameter of the primary internal fluid passage 142 of the first portion 138 of the spray tip body 136 as shown FIGS. 14, 16 and 17 such that a generally annular recirculation passage 184 is defined between the wall of the secondary chamber 180 and the inner wall of the primary fluid passage 142. This annular recirculation passage 184 is in surrounding relation to the secondary chamber 180 and the downstream end of the recirculation passage 184 communicates with the primary fluid passage 142. To permit fluid from the recirculation passage 184 to reenter the secondary chamber 180, a plurality of (in this case two) venturi openings 186 are provided in the wall of the secondary chamber 180 near the upstream end of the secondary chamber 180. These venturi openings 186 extend between the recirculation passage 184 and the secondary fluid passage 182 in the interior of the secondary chamber 180. The low fluid pressure directly downstream of the pre-orifice 134 draws fluid from the recirculation passage 184 into the flow of fluid in the secondary chamber 180 through the venturi openings 186. This recirculation of fluid into the secondary chamber 180 further reduces the velocity of the fluid in the secondary chamber 180 and leads to an increase in drop size. The arrangement and configuration of the venturi openings shown in the figures is meant to be illustrative and it should be understood that other venturi opening arrangements/configurations may also be used.

According to one embodiment, the ratio of the cross-sectional area of the secondary fluid passage 182 of the secondary chamber 180 to the cross-sectional area of the pre-orifice 134, in this case the downstream relatively smaller section 178 of the pre-orifice 134 may be approximately 4:1. Different area ratios may be used depending upon the desired droplet size and/or flow capacity.

As in the embodiment of FIGS. 2-8, the spray tip 114 of FIGS. 9-17 includes a hemispherical second body portion 140 with a dome-shaped end wall 146. This dome-shaped end wall 146 produces a further second drop in the pressure of the fluid in the spray tip 114 and also helps produce atomization of the fluid. The spray tip 114 of FIGS. 9-17 also includes two discharge orifices 148, 150 in the dome-shaped end wall 146 that are configured substantially the same as the discharge orifices 48, 50 of the FIGS. 2-8 embodiment.

Figure 12:
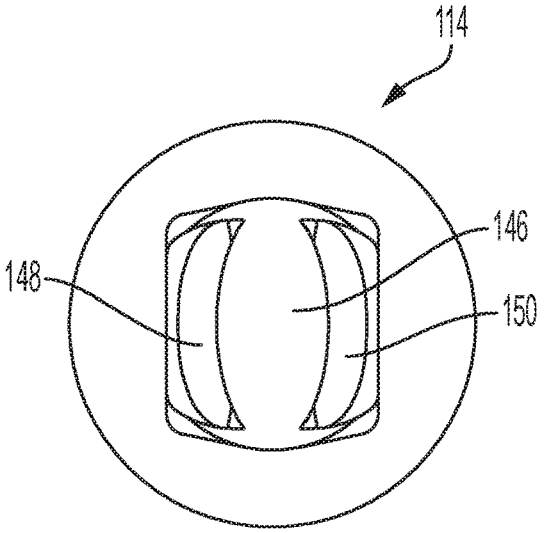
FIG. 12 is an end view of the spray tip of FIG. 9 showing the discharge end of the spray tip.
Figure 13:
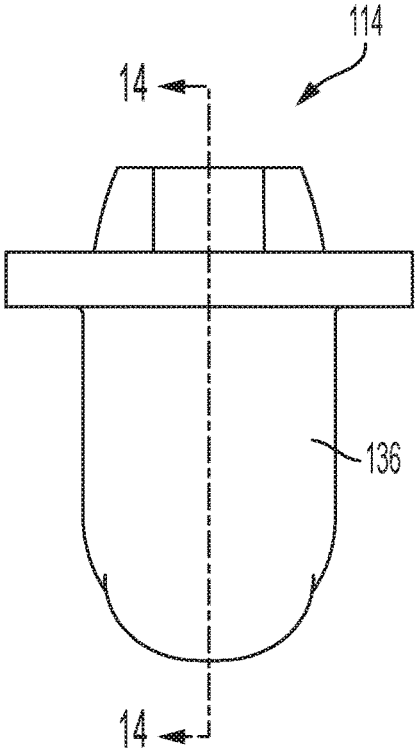
FIG. 13 is a side elevation view of the spray tip of FIG. 9.

To help form the discharge pattern after the fluid exits the discharge orifices 148, 150, the spray tip 114 of FIGS. 9-17 includes fluid deflectors 188, 189. More specifically, a fluid deflector 188, 189 is provided on the outer surface of the dome-shaped end wall 146 adjacent each of the discharge orifices 148, 150 as best shown in FIGS. 10, 12 and 15. The fluid deflectors 188, 189 extend in a downstream direction from the dome-shaped end wall 146. Each fluid deflector 188, 189 presents a deflector surface 190, 191 (see FIG. 15) that is positioned at, and is coplanar with, the radially outward lateral edge 162 of the respective discharge orifice 148, 150. As droplets exit the discharge orifices 148, 150, the fluid deflector surfaces 190, 191 help direct those droplets into a desired spray pattern. Of course, the shape, number and configuration of the fluid deflectors 188, 189 can vary depending upon the desired spray pattern.

As with the spray tip 14 of FIGS. 2-8, the spray tip 114 of FIGS. 9-17 is capable of producing a dual spray pattern with relatively large droplet size, including ultra-coarse droplets, without the use of air induction. Thus, the spray tip 114 of FIGS. 9-17 is compatible with pulse width modulation while maintaining a desired droplet size and spray distribution.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A spray tip operable for spraying a dual spray pattern comprising:

a one piece spray tip body having a first portion and an integrally formed second portion, the first portion having a cylindrical configuration, the second portion including a dome-shaped end wall, the first and second portions of the spray tip body defining an internal primary fluid passage having a longitudinal flow axis extending between an inlet end of said spray tip body and a downstream end defined by the dome-shaped end wall;

a flow control element arranged at the inlet end of the primary fluid passage, the flow control element including a pre-orifice on the longitudinal flow axis through which fluid can enter the primary fluid passage of the spray tip body, the pre-orifice being configured to produce a first drop in fluid pressure as fluid enters the primary fluid passage through the pre-orifice during operation of the spray tip and wherein the fluid passes through said primary fluid passage without air introduction, into said primary fluid passage during operation of the spray tip and a second drop in fluid pressure is produced as fluid contacts the dome-shaped end wall and is atomized; and first and second discharge orifices in the dome-shaped end wall with each of the first and second discharge orifices being arranged on a respective one of opposing first and second sides of an apex of the dome-shaped end wall for discharging liquid from said primary fluid passage into the atmosphere without pressurized air induction, each of the first and second discharge orifices having an elongated slot-like configuration that maintains a substantially constant width as the respective discharge orifice extends from a first end to a second end, each of the first and second discharge orifices extending a substantially equal distance to either side of the apex of the dome-shaped end wall, each of the first and second discharge orifices having a centerline that is at a substantially similar angle with respect to a longitudinal axis of the nozzle body.

2. The spray tip of claim 1 further including a flow control guide arranged on an upstream side of the flow control element near the pre-orifice, the flow control guide including an inner surface that is substantially smooth in a direction of fluid flow and is configured to help produce laminar flow of fluid to the pre-orifice.

3. The spray tip of claim 2 wherein the flow control guide is one of a pair of flow control guides each having a C-shaped configuration that is substantially centered on the pre-orifice with the pair of flow control guides at least partially encircling the pre-orifice.

4. The spray tip of claim 3 wherein each of the pair of flow control guides has a substantially flat gripping surface on an outer surface of the respective flow control guide with the flat gripping surfaces being arranged opposite each other.

5. The spray tip of claim 1 wherein a pair of fluid deflectors are provided on an outer surface of the dome-shaped end wall with one fluid deflector being arranged adjacent a each of the discharge orifices, each fluid deflector presenting a deflector surface that is positioned at, and coplanar with, an outward edge of the respective discharge orifice.

6. The spray tip of claim 1 wherein the flow control element comprises a member that is received in a corresponding opening in an inlet end of the spray tip body.

7. A spray nozzle assembly comprising:

a spray tip operable in spraying a dual spray pattern comprising:

a one piece spray tip body having a first portion and a second portion, the first portion having a cylindrical configuration, the second portion including a dome-shaped end wall, the first and second portions of the spray tip body defining an internal primary fluid passage having a longitudinal flow axis extending between an inlet end of said spray tip body and a downstream end defined by the dome-shaped end wall;

a flow control element arranged at the inlet end of the primary fluid passage, the flow control element including a pre-orifice on the longitudinal flow axis through which fluid can enter the primary fluid passage of the spray tip body, the pre-orifice during operation of the spray nozzle assembly being configured to produce a first drop in fluid pressure as fluid enters the primary fluid passage through the pre-orifice and wherein the fluid passes through said primary fluid passage without air introduction into said primary fluid passage during operation of said spray tip and a second drop in fluid pressure is produced as fluid contacts the dome-shaped end wall and is atomized; and first and second discharge orifices in the dome-shaped end wall with each of the first and second discharge orifices being arranged on a respective one of opposing first and second sides of an apex of the dome-shaped end wall for discharging liquid from said primary fluid passage into the atmosphere without pressurized air induction, each of the first and second discharge orifices having an elongated slot-like configuration that maintains a substantially constant width as the respective discharge orifice extends from a first end to a second end, each of the first and second discharge orifices extending a substantially equal distance to either side of the apex of the dome-shaped end wall, each of the first and second discharge orifices having a centerline that is at a substantially similar angle with respect to a longitudinal axis of the nozzle body; and a pulse width modulation assembly including an electrically actuated on/off solenoid valve that can oscillate rapidly between an open position in which fluid is allowed to pass to the pre-orifice of the spray tip and a closed position in which the flow of fluid to the spray tip is blocked.

8. The spray nozzle assembly of claim 7 further including a flow control guide arranged on an upstream side of the flow control element near the pre-orifice, the flow control guide including an inner surface that is substantially smooth in a direction of fluid flow and is configured to help produce laminar flow of fluid to the pre-orifice.

9. The spray nozzle assembly of claim 8 wherein the flow control guide is one of a pair of flow control guides each having a C-shaped configuration that is substantially centered on the pre-orifice with the pair of flow control guides at least partially encircling the pre-orifice.

10. The spray nozzle assembly of claim 9 wherein each of the pair of flow control guides has a substantially flat gripping surface on an outer surface of the respective flow control guide with the flat gripping surfaces being arranged opposite each other.

11. The spray nozzle assembly of claim 7 wherein a secondary chamber defining a secondary fluid passage is arranged in the primary fluid passage, the secondary chamber being arranged such that fluid entering the spray tip body via the pre-orifice is communicated into the secondary fluid passage.

12. The spray nozzle assembly of claim 11 wherein the secondary chamber extends less than the entire length of the first portion of the spray tip body and is open at a downstream end thereof such that fluid exiting the secondary fluid passage is directed into the primary fluid passage.

13. The spray nozzle assembly of claim 12 wherein a recirculation passage is defined between a wall of the secondary chamber and an inner wall of the primary fluid passage, the recirculation passage being in communication at a downstream end with the primary fluid passage, the recirculation passage being in communication with the secondary fluid passage via a plurality of venturi openings in the wall of the secondary chamber near an upstream end of the secondary chamber.

14. The spray nozzle assembly of claim 12 wherein a ratio of a cross-sectional area of the secondary fluid passage to a cross-sectional area of the pre-orifice is 4:1.

15. The spray nozzle assembly of claim 7 wherein a pair of fluid deflectors are provided on an outer surface of the dome-shaped end wall with one fluid deflector being arranged adjacent a each of the discharge orifices, each fluid deflector presenting a deflector surface that is positioned at, and coplanar with, an outward edge of the respective discharge orifice.

16. The spray nozzle assembly of claim 7 wherein the flow control element comprises a member that is received in a corresponding opening in an inlet end of the spray tip body.

17. A spray tip comprising:

a spray tip body having a first portion and a second portion, the first portion having a cylindrical configuration, the second portion including a dome-shaped end wall, the first and second portions of the spray tip body defining an internal primary fluid passage having an inlet end and a downstream end defined by the dome-shaped end wall;

a flow control element arranged at the inlet end of the primary fluid passage, the flow control element including a pre-orifice through which fluid can enter the primary fluid passage of the spray tip body, the pre-orifice being configured to produce a first drop in fluid pressure as fluid enters the primary fluid passage through the pre-orifice and wherein a second drop in fluid pressure is produced as fluid contacts the dome-shaped end wall and is atomized;

a secondary chamber defining a secondary fluid passage is arranged in the primary fluid passage, said secondary chamber being arranged such that fluid entering the spray tip body via the pre-orifice is communicated into the secondary fluid passage; said secondary chamber extending less than the entire length of the first portion of the spray tip body and is open at a downstream end thereof such that fluid exiting the secondary fluid passage is directed into the primary fluid passage; a recirculation passage defined between a wall of the secondary chamber and an inner wall of the secondary chamber and an inner wall of the primary fluid passage, said recirculation passage being in communication at a downstream end with the primary fluid passage, said recirculation passage being in communication with the secondary fluid passage via a plurality of venture openings in the wall of the secondary chamber near an upstream end of the secondary chamber; and first and second discharge orifices in the dome-shaped end wall with each of the first and second discharge orifices being arranged on a respective one of opposing first and second sides of an apex of the dome-shaped end wall, each of the first and second discharge orifices having an elongated slot-like configuration that maintains a substantially constant width as the respective discharge orifice extends from a first end to a second end, each of the first and second discharge orifices extending a substantially equal distance to either side of the apex of the dome-shaped end wall, each of the first and second discharge orifices having a centerline that is at substantially the similar angle with respect to a longitudinal axis of the nozzle body.

18. The spray tip of claim 17 wherein a ratio of a cross-sectional area of the secondary fluid passage to a cross-sectional area of the pre-orifice is 4:1.

* * * * *